US006449938B1

(12) United States Patent
Kutsenko et al.

(10) Patent No.: US 6,449,938 B1
(45) Date of Patent: Sep. 17, 2002

(54) ADVANCED FINISH NOZZLE SYSTEM

(75) Inventors: Michael Kutsenko, Monroe; Donald Faulkner, Charlotte, both of NC (US)

(73) Assignee: Goulston Technologies, Inc., Monroe, NC (US)

( * ) Notice: Subject to any disclaimer, the term of this patent is extended or adjusted under 35 U.S.C. 154(b) by 0 days.

(21) Appl. No.: 09/576,761

(22) Filed: May 24, 2000

(51) Int. Cl.[7] ..... D02G 1/16
(52) U.S. Cl. ..... 57/350; 57/295
(58) Field of Search ..... 57/282, 283, 284, 57/286, 289, 290, 292, 295, 296, 332, 333, 350; 28/220, 246, 271, 282, 283; 8/151.2

(56) References Cited

U.S. PATENT DOCUMENTS

| | | | | |
|---|---|---|---|---|
| 2,966,198 A | | 12/1960 | Wylde | |
| 3,201,931 A | | 8/1965 | Caroselli et al. | |
| 3,226,773 A | | 1/1966 | Paliyenko | |
| 3,262,181 A | | 7/1966 | Hawkins et al. | |
| 3,282,768 A | | 11/1966 | Caines et al. | |
| 3,443,284 A | | 5/1969 | Kalwaites et al. | |
| 3,534,453 A | | 10/1970 | Lefebvre | |
| 3,577,615 A | | 5/1971 | LeNoir | |
| 3,751,775 A | | 8/1973 | Psaras | |
| 3,783,596 A | * | 1/1974 | Waldkirch | 57/157 |
| 3,828,404 A | | 8/1974 | Peckinpaugh et al. | |
| 3,845,528 A | | 11/1974 | Vermeer et al. | |
| 3,874,045 A | | 4/1975 | Butler et al. | |
| 4,064,684 A | | 12/1977 | Nijhuis | |
| 4,148,179 A | | 4/1979 | Becker et al. | |
| 4,237,187 A | * | 12/1980 | Raybon, Jr. et al. | 428/399 |
| 4,277,430 A | | 7/1981 | Peckinpaugh et al. | |
| 4,444,003 A | | 4/1984 | Götzfried | |
| 4,476,807 A | | 10/1984 | Pryor | |
| 4,509,322 A | | 4/1985 | Briner et al. | |
| 4,565,063 A | | 1/1986 | Stadler et al. | |
| 4,704,311 A | | 11/1987 | Pickering et al. | |
| 4,768,336 A | | 9/1988 | Stahlecker et al. | |
| 4,873,144 A | | 10/1989 | Marshall | |
| 5,003,677 A | | 4/1991 | Krenzer | |
| 5,119,623 A | | 6/1992 | Fetzer et al. | |
| 5,340,609 A | | 8/1994 | Arthur et al. | |
| 5,976,431 A | | 11/1999 | Mears | |

FOREIGN PATENT DOCUMENTS

| | | |
|---|---|---|
| WO | WO 00/52240 | 9/2000 |

* cited by examiner

*Primary Examiner*—Danny Worrell
*Assistant Examiner*—Shaun R Hurley
(74) *Attorney, Agent, or Firm*—Sughrue Mion, PLLC

(57) ABSTRACT

A process for improving the uniformity of yarn finish application on the individual filaments of a rapidly advancing synthetic continuous monofilament, bonded multi-filament, multi-filament hosiery, textile, technical and industrial yarns includes imparting a pneumatic false twist to the advancing yarn having a wet finish thereon while the yarn is under a tension allowing the rapid opening and closing of the multi-filament yarn but preventing texturing or coherency from increasing by commingling of the yarn filaments in the false twister. A nozzle has a reduced friction and can either be used as a stand-alone air bearing or to apply finish within the nozzle. A plurality of finish delivery orifices open into the chamber in a low pressure zone inside the nozzle, and wherein the exact same or slightly greater pressure that is used for the compressed air supplied to the air delivery orifices is used to actuate the finish supplied to the plurality of the finish delivery orifices. The process and apparatus can also be used with monofilament textile yarn and bonded textile yarn.

12 Claims, 4 Drawing Sheets

ADVANCED FINISH NOZZLE SYSTEM

FIELD OF THE INVENTION

The invention relates to a twisting nozzle used as a processing aid in the manufacture of multi-filament yarn. More particularly, the invention concerns a system that includes processes and equipment for improving the uniformity of yarn finish application on the individual filaments of rapidly advancing yarn by utilizing a pneumatic false twister.

BACKGROUND AND SUMMARY OF THE INVENTION

A conventional method disclosed in U.S. Pat. No. 3,201,931 separates yarns having continuous fibers in order to bulk the yarn by feeding the yarn into a jet of air, so that the yarn is supported by the jet of air and the individual filaments are separated from each other. The separated individual fibers are thus passed through a turbulent area where intermingling and texturing occurs. The bulked yarn is then passed through a dye bath.

A process of twisting of filaments into a cohesive single yarn entity is disclosed in U.S. Pat. No. 3,534,453, where the resultant yarn bundle is textured via pneumatic means and atomized dye stuffs are introduced via the sonic or subsonic fluid flows before the yarn bundle is completely closed by the twisting action of the flow currents. The thread enters the interior of a nozzle and a stream of pressurized air enters a 'heart-shaped' "bulb" or annulus through a duct. The position of the duct relative to the nozzle axis produces the familiar effect of the required amount of twisting, fixing, and untwisting. A "true twist" of the yarn bundle is a result of this process, and the manifestation of false twist "S" or "Z" patterns in individual discrete filaments in the resultant processed yarns is due to either direct contact with the chamber wall or the interactions of subsonic and sonic pneumatic flows within the nozzle chamber on the plurality of fibers.

A method for opening and applying finishes to multifilament tows is disclosed in U.S. Pat. No. 3,226,773, in which a compressed air stream is used for spreading and separating the filaments of a tow bundle and for carrying the particles, droplets, or mist of the finish composition to be applied to the filaments. In actual practice, the oscillation of the advancing tow bundle within the nozzle chamber creates momentary flow disturbances in the plenum chamber and supply metering orifice that alter the concentrations of entrained atomized finish particles. Sufficient filament displacement occurs within the advancing tow bundle for it to be described as "fleecy," intermingling and interlacing thereby occuring.

The invention relates to a finish application system that uses several variations of air nozzles that are somewhat similar to conventional interlacers/interminglers, but have completely different functions. Conventional interlacers/interminglers operate at relatively high pressures (up to 4 bars) and are designed to provide additional cohesion to the filament yarn by creating so-called nodes or loose knots. The conventional devices are designed to work at very low tensions and are not suitable for finish application.

The invention relates to the application of yarn finishes, such as those containing lubricants and/or other additives, to the advancing filaments within the converged yarn bundle in state-of-the-art high speed extrusion processes for yarns formed of man-made and/or natural polymeric materials. These processes have reached speed ranges of as much as 3000–8000 meters per minute, where the extrusion tension levels and the residence times on the conventional wetted type applicator surfaces preclude a high degree of uniform and consistent capillary action on the individual filaments within the yarn bundle. This can be attributed to several causes: the entrained boundary layer of cooling air flow that each filament brings to the applicator; the residual retraction forces associated with filament tension that are still remaining in the filaments within the advancing yarn bundle due to the drawing process; the apparent viscosity phenomena associated with the high speed contact of the filaments within the advancing yarn bundle with the pool of yarn finish containing lubricants, and/or other additives on the wetted applicator surface; and, due to the applicator's ability to renew the pool of finish under the yarn bundle contact zone.

In order to reduce these and other conventional problems associated with uniformity of finish application, it is an object of the present invention to dissipate the entrained boundary of air, steam, inert gas, or other types of cooling or heating fluids that inhibit the uptake of the yarn finish containing lubricants or other additives on the advancing yarn bundle prior to the entrance of the yarn bundle into a nozzle device.

It is an additional object of the present invention to disturb the linear interfilament cohesion within the advancing fiber bundle that inhibits the attachment of yarn finish through capillary action without also creating noticable sinusoidal and or nodal mixing patterns (known as "intermingling" or "interlacing" patterns) in the advancing yarn fiber bundle that could inhibit downstream processing techniques.

It is a further object of the present invention to introduce yarn finish containing lubricants, or other additives, into an applicator chamber that provides for low pressure contact of the individual filaments with the wetted surfaces of the applicator chamber and with the atomized fluid volume within the nozzle chamber.

It is another object of the present invention to provide a low pressure nozzle chamber that dampens pressure and volumetric irregularities in the introduction of the yarn finish into the applicator chamber.

Yet another object of the present invention is to immediately close the opened filaments of the advancing fiber bundle containing the yarn finish immediately after passing the nozzle, in order to aid in the prevention of the previously applied finish being stripped off by the reattachment of the boundary layer air, after the yarn passes through the nozzle.

Still another object of the present invention is to provide a type of air bearing yarn filament support medium within the applicator chamber, to inhibit the escalation of tension in the advancing yarn line normally associated with direct fiber filament contact with the application surface.

An additional object of the present invention is to introduce more surfaces of the advancing filament bundle cross sections to the wetted surfaces of the applicator and to the atomized finish particles within the nozzle chamber.

Another object of the present invention is to allow the applicator to renew with finish the application surfaces of the applicator, in order to facilitate the uniform and consistent presentation of the finishes to the advancing yarn line.

Another object of the present invention is to reduce the friction and the friction buildup of the yarn within the nozzle chambers, so that the moving yarn may be opened or closed under high tension, allowing the nozzle to act as an air bearing.

Different air pressures can be used to operate the pneumatic false twister. Low pressure (up to 2 bars) air nozzles can be used for the application of yarn finish processing aid components. The Advanced Finish Nozzle (AFN) of the present invention contains compressed air delivery orifices that are used to effect the false twisting and untwisting of the yarn within the nozzle. When air pressure is applied to the AFN, the yarn filaments remain twisted together, and when no air pressure is applied to the AFN the yarn remains untwisted. The AFN is capable of opening and closing of multi-filament yarn at high tensions (up to 1.0 gram per denier) by the application of a "S/Z" semi-twist, or false twist, to the moving yarn. The AFN is also designed to apply finish onto the moving yarn while "open" inside of the nozzle. The nozzle can be used immediately after a conventional application of a liquid finish to the multifilament yarn, or can contain additional orifices that are used to spray the finish onto the yarn while the yarn has been opened by the nozzle and before the yarn closes into its normal state. This action allows for extremely uniform finish application especially in situations where some additional amount of finish has to be applied on already spun and drawn (or even heat set) yarns.

The nozzle is designed so that an air bearing curtain (e.g., helix) is provided surrounding the advancing threadline to cause an orbital dislocation , thereby separating and opening the yarn bundle. A convergence of the thread can occur within or just after passing the nozzle.

The AFN does not use the atomizing of particles of finish for reasons of system complexity and overall variability of finish concentrations. The AFN requires the delivery of a metered stream of yarn finish directly into the yarn processing chamber and thereby improves over conventional systems such as the above-mentioned U.S. Pat. No. 3,226,773.

The manifestation of the "S" or "Z" twist patterns in the filaments of the advancing yarn bundle in the AFN is the result of individual filaments within the advancing yarn bundle accepting rotational torque and radial bundle displacement from the helical discharge path of the perimeter air currents within the nozzle chamber. The algebraic sum of this twist is zero when measured over a certain length of the yarn bundle.

BRIEF DESCRIPTION OF THE DRAWINGS

The invention, together with further objects and advantages thereof may be understood by reference to the following description, taken in conjunction with the accompanying drawings.

DESCRIPTION OF THE PREFERRED EMBODIMENT

Figure 1:
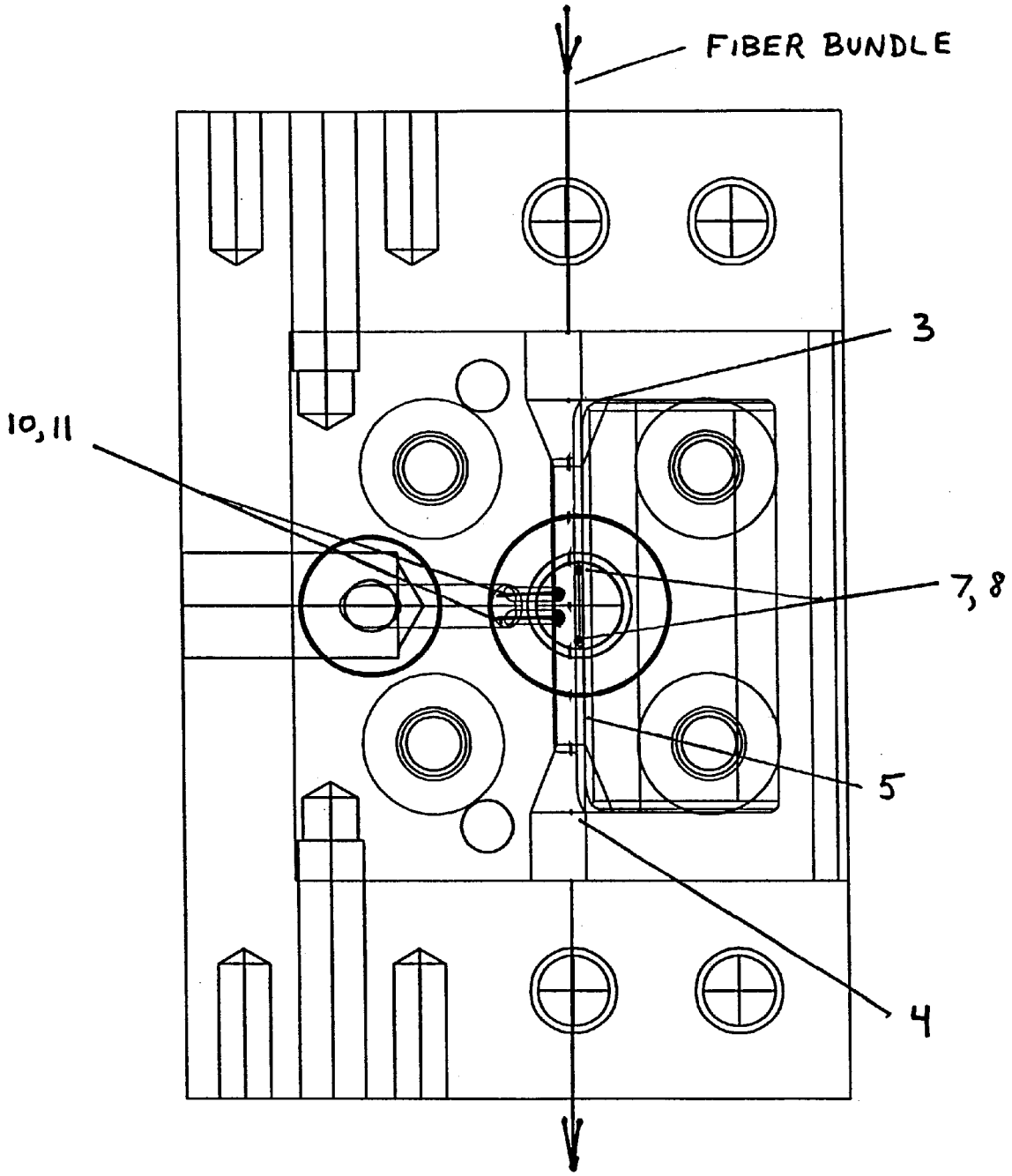
FIG. 1 shows a top view of an AFN nozzle assembly according to the present invention.

The AFN can apply finish onto the moving yarn while the yarn is "open" inside of the nozzle. AFN opening and closing performance is related to parameters of speed, tension, and pressure.

Experimental testing was performed where the goals of the testing program were to confirm opening-closing action of the AFN nozzle design, characterize friction build-up at the nozzle, and to evaluate the effect of the nozzle on finish level and finish uniformity. Testing was done using 126-denier 34 filament polyester finish free POY (partially oriented) yarn loaded on a high-speed Fiber-to-Metal (F/M) friction meter and run at 100, 200, 500, and 1000 m/min. The AFN, and optionally a ceramic finish application guide, was installed between the load cells of the friction meter and connected to a regulated air supply, which provided up to two bars of pressure. Images of the nozzle action were taken using a high-speed (1000 frames/sec.) camera. The photographs confirmed the opening/closing action of the AFN and allowed for evaluation of the opening frequency and action of the nozzle. An average opening frequency was established as 345±106 Hz for all experimental conditions (i.e., speed, tension, pressure). The opening/closing action of the AFN has a generally multifrequency character rather than a single frequency one. Testing that combines black and white yarns will better illustrate the AFN action.

The importance of friction build-up on the applicator guides must be emphasized. In many modern man-made fiber processes, friction build-up on stationary surfaces limits production speeds. For example, at speeds above 4000 m/min., fiber producers are forced to use special low friction ceramic to minimize the friction drag over the applicator guides. The current industry standard is the special "rough" ceramic guide produced by Kyocera and others. The new AFN design is intended to be used either with or without a standard ceramic finish application guide. The AFN is intended to be used either as a stand-alone finish applicator nozzle, or as a complementary device to enhance the finish uniformity of a standard applicator nozzle placed either before or after the AFN nozzle. In either case, the AFN is designed to generate friction build-up comparable with existing low friction ceramic applicator guides.

To investigate friction build-up on the AFN nozzle, a coefficient of friction was measured at a wide range of speeds and pretensions, and then compared with a coefficient of friction measured for a low friction ceramic guide, which is considered an industry standard for a low friction surface. The same 126/34 finish-free polyester yarn was used for this test. Results of the friction testing are summarized in Table 1. Investigated variables were tension ($T_1$, grams), pressure (P, bars), and yarn speed (V, m/min.). The results illustrate that although the prototype was actually made from highly polished stainless steel, which has an inherently higher coefficient of friction compared to ceramic, the nozzle produced less friction build-up.

TABLE 1

Friction Build-up

| Guide Setup | $T_1$ (grams) | P (Bar) | Yarn Speed V, m/min 100 | 250 | 500 | 1000 |
|---|---|---|---|---|---|---|
| AFN Alone | 12 | 1 | 0.097 | 0.126 | 0.169 | 0.211 |
| | | 1.5 | 0.094 | 0.134 | 0.167 | 0.211 |
| | | 2 | 0.097 | 0.125 | 0.163 | 0.212 |
| | 18 | 1 | 0.073 | 0.092 | 0.144 | 0.183 |
| | | 1.5 | 0.066 | 0.090 | 0.117 | 0.180 |
| | | 2 | 0.072 | 0.089 | 0.119 | 0.183 |
| | 24 | 1 | 0.059 | 0.073 | 0.093 | 0.142 |
| | | 1.5 | 0.058 | 0.071 | 0.090 | 0.144 |
| | | 2 | 0.053 | 0.074 | 0.095 | 0.149 |
| Ceramic Guide + AFN | 12 | 1 | 0.105 | 0.135 | 0.173 | 0.258* |
| | | 1.5 | 0.102 | 0.133 | 0.182 | 0.200 |
| | | 2 | 0.101 | 0.132 | 0.182 | 0.207 |

TABLE 1-continued

| Friction Build-up | | | | | | |
|---|---|---|---|---|---|---|
| | $T_1$ | P | Yarn Speed V, m/min | | | |
| Guide Setup | (grams) | (Bar) | 100 | 250 | 500 | 1000 |
| | 18 | 1 | 0.072 | 0.090 | 0.118 | 0.186 |
| | | 1.5 | 0.073 | 0.090 | 0.112 | 0.192 |
| | | 2 | 0.070 | 0.101 | 0.133 | 0.188 |
| | 24 | 1 | 0.059 | 0.069 | 0.092 | 0.146 |
| | | 1.5 | 0.061 | 0.074 | 0.099 | 0.146 |
| | | 2 | 0.060 | 0.082 | 0.106 | 0.150 |
| Ceramic Guide Alone | 12 | N/A | 0.085 | 0.109 | 0.142 | 0.213 |
| | 18 | | 0.063 | 0.083 | 0.097 | 0.176 |
| | 24 | | 0.051 | 0.066 | 0.082 | 0.124 |

*Yarn starts to break at these conditions.

Data presented in Table 1 indicates that the coefficient of friction on both the ceramic finish application guide and the AFN significantly increases with the yarn speed. Increase in the input yarn tension leads to a lower coefficient of friction, which is in excellent agreement with existing friction theory. At the same time, the effect of operation pressure is negligibly small, and may be easily omitted from further consideration. This actually means that the AFN is quite adaptable and may be operated in a reasonably wide range of pressures. Interestingly enough, the coefficient of friction measured for the combination of the AFN and ceramic finish applicator guide is actually lower than the sum of the individual coefficients of friction. This result actually confirms the wiping action of the AFN, which apparently leads to a lowering of a contact area between the ceramic application guide and moving yarn. To summarize the friction experiments: the AFN showed approximately 14% higher friction than the low friction ceramic guide; the combination of the AFN and ceramic applicator guide showed a 17% higher coefficient of friction compared to the low friction ceramic applicator guide alone.

Thorough comparison of friction surfaces involves 3-dimensional plots of yarn speed v. input tension v. coefficient of friction, for each of the AFN, ceramic guide, and the combination of AFN+ceramic guide. The comparison reveals one very important detail of the AFN's performance. For the ceramic applicator guide, the higher the speed the higher the friction, and such an increase is virtually linearly proportional to the yarn speed. At the same time, the AFN exhibits a slowing of friction build-up with increased speed, and this effect is also pronounced for the combination of the AFN and ceramic applicator guide. This means that at yarn speeds exceeding 1000 m/min., friction build-up for the AFN will be smaller compared to the ceramic applicator guide alone.

Figure 4:
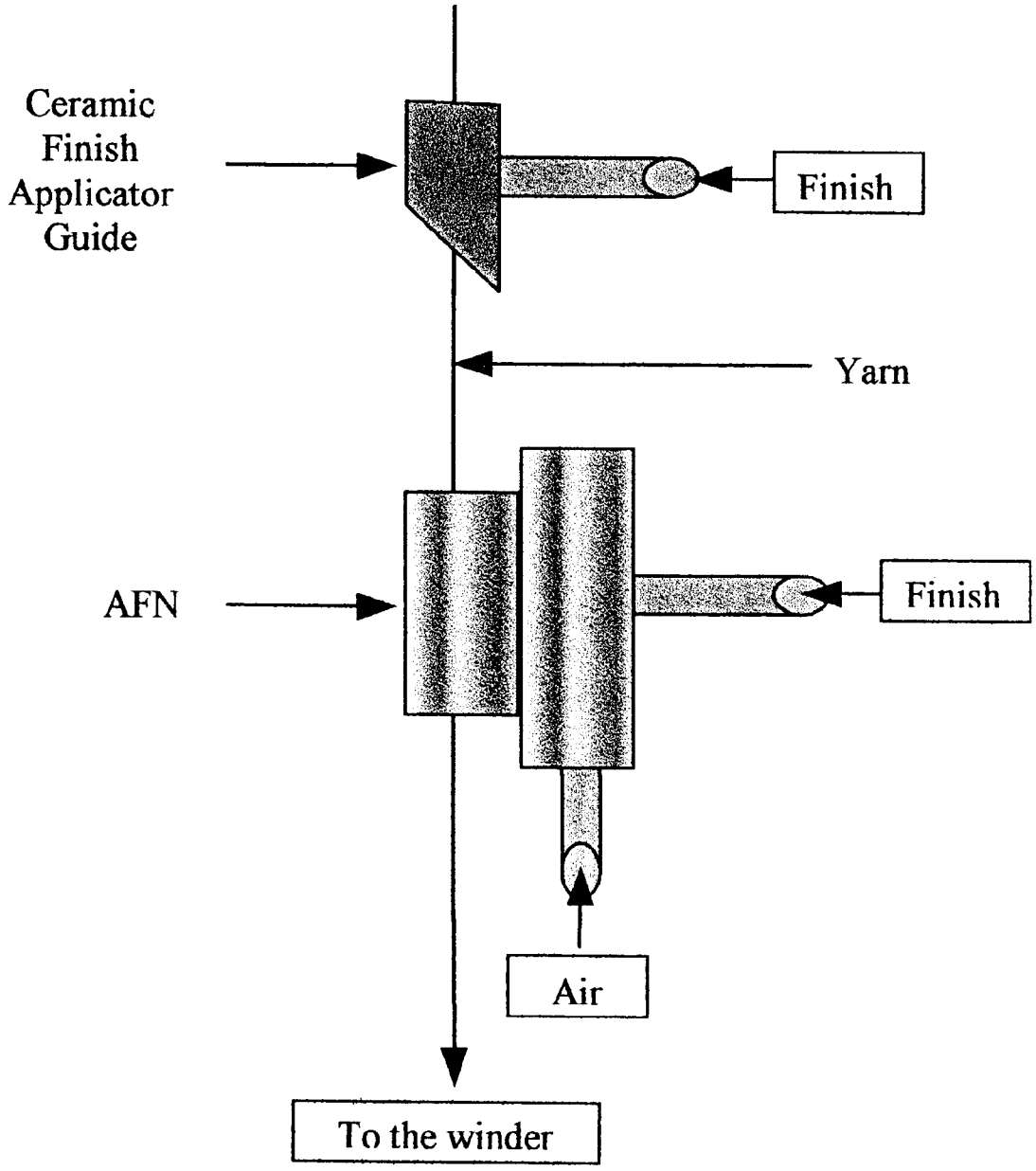
FIG. 4 is a schematic view of a preferred rig used for finish application according to the invention.

Next, finish application and finish uniformity evaluations are summarized. The AFN allows for the direct injection and application of the yarn finish directly into the yarn processing chamber and not into the compressed air stream as the injection of finish lubricants into the compressed air stream creates back pressure in the finish lines, which can lead to periodic blockages of the finish flow and corresponding sputtering of the finish flow when the pressure is again equalized by the positive pump feed. This problem is solved by the addition of separate finish delivery orifices in the low pressure zone inside the nozzle and by using the same pressure or a slight higher pressure to actuate the finish supply. The feasibility of using the AFN as a stand-alone finish applicator guide, and its ability to improve uniformity of finish distribution on the applied yarns were evaluated. To accomplish this task, finish neat and from 10% emulsion was applied onto 126/34 finish-free polyester yarn. Application speed was set at 200 m/min. and target FOY (finish on yarn) level was 1%. The schematic of the application rig is shown in FIG. 4. Operating air pressure for the AFN was set at 2 bar for all experiments. Lurol PT-128 was used as the finish and, in order to characterize finish uniformity, a fluorescent tracer was added at 0.1% w/w to the oil base. After conditioning, the applied yarns were examined by high-resolution dynamic fluorometry to characterize finish uniformity. Dynamic fluorometry tests were run at 5.4 m/min. and 30 Hz acquisition frequency. At these test conditions resolution is 3 mm for the length of the yarn. This test yields an absolute mean and a percent CV (coefficient of variation, which is equal to standard deviation divided by the mean). The absolute mean is a direct measure of the finish level on the yarn, while the %CV is a quantitative characteristic of finish uniformity. The lower the %CV, the better the uniformity of finish distribution along the yarn. Actual finish levels (FOY) were determined by cold solvent extraction with an isopropanol/hexane mixture. The %FOY was determined using the isopropanol/hexane cold solvent method. Generated results are summarized in Table 2. Data in Table 2 shows that the AFN indeed improves uniformity of finish distribution in both cases of neat and emulsion application. It also provides finish levels closer to the theoretical ones compared to the regular ceramic applicator guide.

TABLE 2

| Effect of AFN on Finish Uniformity and Finish Level | | | | | | |
|---|---|---|---|---|---|---|
| Sample | Setup | | Appli- | Absolute | | |
| LD. | Applicator | Air Supply | cation | Mean | %CV | %FOY |
| A | Ceramic Applicator | None | Neat | 1.26 | 55.4 | 0.80 |
| B | Ceramic Applicator | AFN (2 bars) | | 1.35 | 49.5 | 0.85 |
| C | AFN | AFN (2 bars) | | 1.68 | 48.2 | 0.99 |
| D | Ceramic Applicator | None | Emul-sion | 0.97 | 60.6 | 0.79 |
| E | Ceramic Applicator | AFN (2 bars) | | 1.09 | 32.9 | 0.84 |
| F | AFN | AFN (2 bars) | | 1.13 | 33.2 | 0.92 |

As mentioned above, the most drastic effect of the AFN action can be seen in the improvement of finish uniformity. Finish uniformity was improved more then 12% in the case of neat application and almost twice in the case of emulsion. Even addition of the AFN after the ceramic applicator guide noticeably improved finish uniformity. This effect is explained by the wiping action of the twisted yarn across the ceramic applicator guide.

The new AFN design is intended to be used either with or without a ceramic applicator guide or other type of finish applicator upstream of the AFN. A twisting and wiping motion of the yarn across the guide is caused by the twisting action of the AFN. When the nozzle is installed after such a conventional ceramic applicator guide, the wiping action is beneficial for enhancing the uniformity of finish distribution and preventing a dripping of finish from the applicator guide.

The thorough testing of the Advanced Finish Nozzle (AFN) thus confirms the revolutionary nature of this device in the field of spin finish application technology. The most advantageous features of the AFN are the opening/closing action of the filament bundle, wiping effect over the ceramic guide (where used) leading to enhanced finish uniformity, and ability for extremely (approximately twice as effective in enhancing the finish uniformity when compared to regular applicator guides) uniform finish application.

The AFN is intended to be used either as a stand alone finish applicator nozzle, or as a complementary device to enhance finish uniformity.

Figure 2:
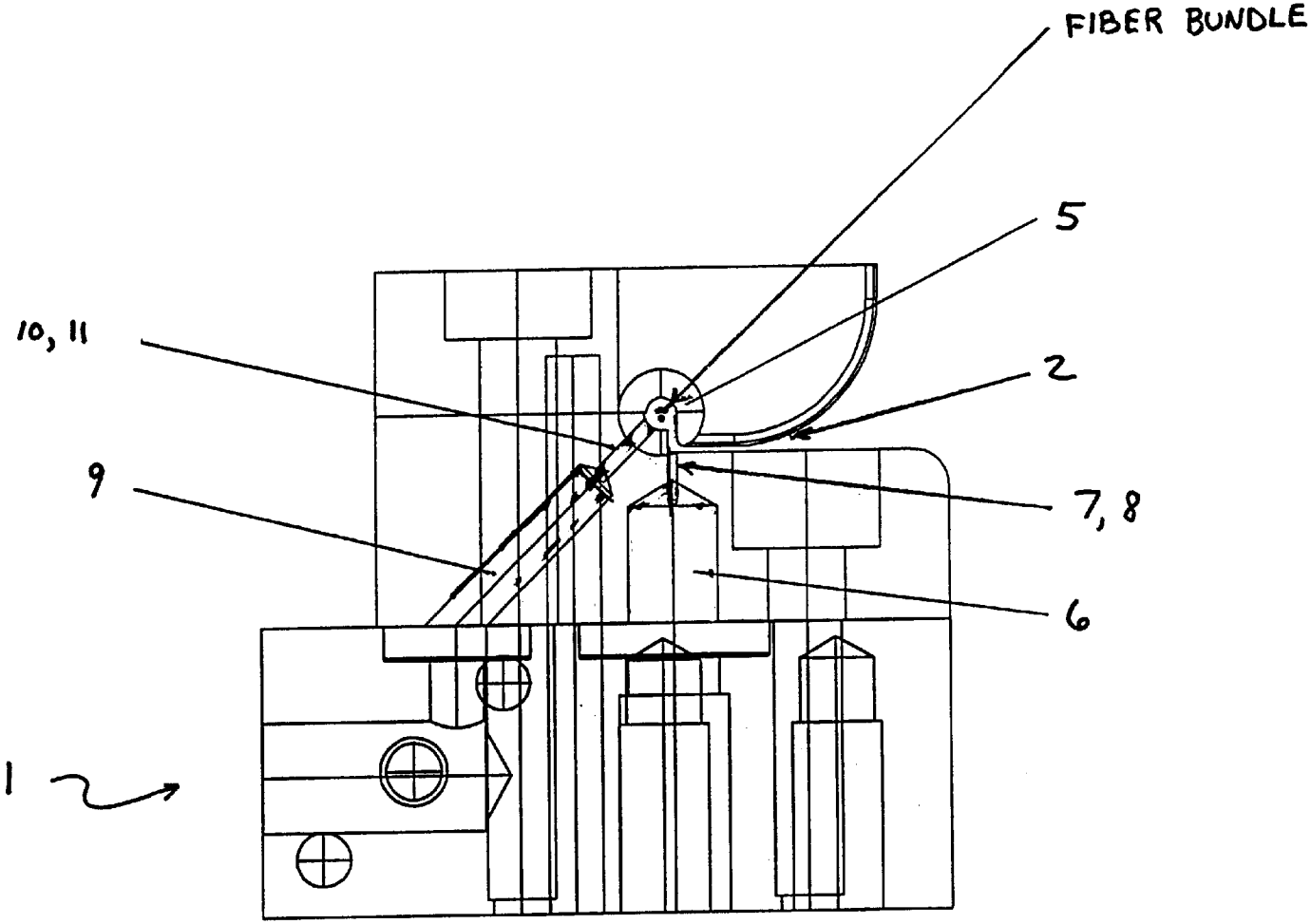
FIG. 2 is a side view of the AFN nozzle assembly shown in FIG. 1.

An embodiment of the invention as illustrated in FIGS. 1 and 2 is now described. The yarn enters the AFN 1 as a fiber bundle. The fiber bundle can be placed in the AFN 1 during setup by temporarily loosening a tension on the fiber bundle and slipping the fiber bundle into the AFN via fiber bundle entry slot 2. A loosening of the tension on the fiber bundle may not be required where the yarn material is flexible or where the tension is not great. A tensioning of the fiber bundle may then be adjusted after placement in the AFN 1 is completed. The fiber bundle passes in a lengthwise direction through the AFN by entering the fiber bundle entry 3, passing through a fiber processing chamber 5, and then exiting through a fiber bundle exit 4. The AFN can be positioned so that, when properly tensioned, the fiber bundle's passage through the AFN is approximately centered with respect to fiber bundle entry 3, fiber processing chamber 5, and fiber bundle exit 4, so that the fiber bundle does not rub against the corresponding surfaces of the passage.

The fiber bundle entry slot 2, as shown in FIG. 2, is constructed so that its end view cross section is rounded, allowing the fiber bundle to be easily inserted laterally into the AFN. This fiber bundle entry slot 2 divides a lengthwise half of the AFN laterally and then turns 90° and connects to the fiber processing chamber 5. The edges of the corresponding surfaces throughout the fiber bundle entry slot 2 are each rounded in order to prevent damage to the yarn and provide smoother insertion of the fiber bundle into the AFN. The fiber bundle entry 3 and the fiber bundle exit 4 each have a funnel shape that opens out from the fiber processing chamber 5. This funnel shape can be optimized for both a desired internal pressure within the fiber processing chamber 5 as well as a control of the boundary layer air.

Figure 3A:
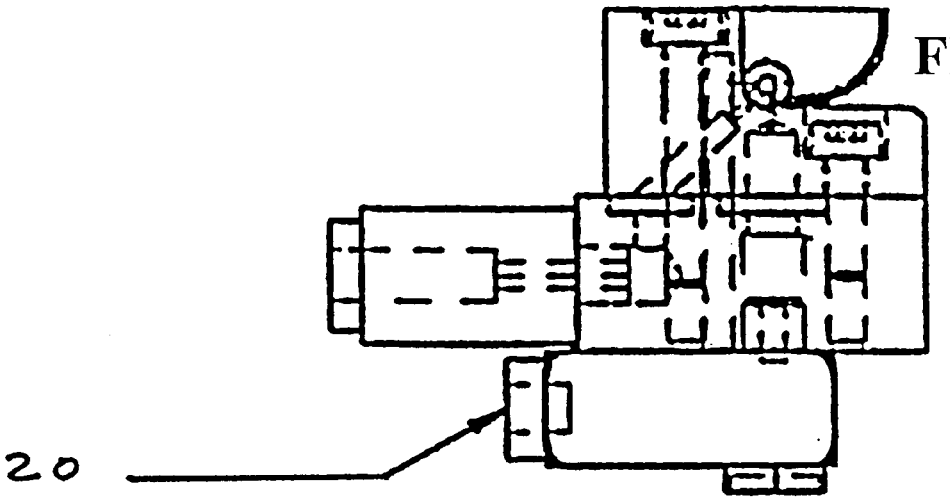
FIGS. 3A and 3B are a side and bottom view, respectively, of an AFN nozzle assembly having tube fittings for supplying of compressed air or other fluid medium and yarn finish lubricant.
Figure 3B:
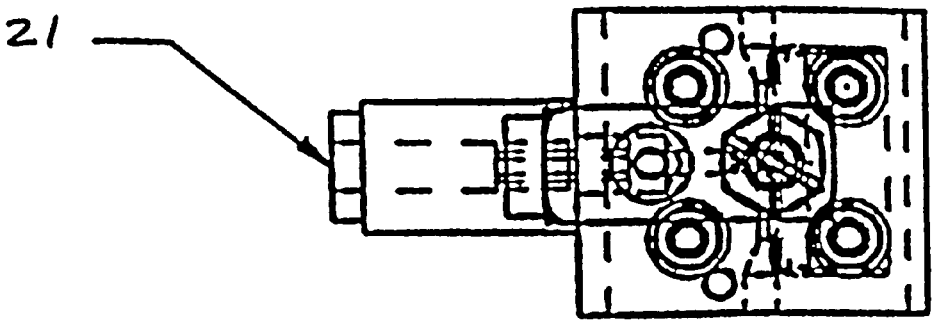

An air supply tube fitting 20, shown in FIG. 3A, connects an external pressurized air supply to the AFN. A compressed air plenum 6 delivers the pressurized air from the air supply tube fitting 20 to a pair of compressed air delivery orifices 7, 8 positioned parallel to each other along a centered diameter line of the compressed air plenum 6, the centered diameter line of the compressed air plenum 6 being parallel to and laterally offset from the advancing yarn fiber bundle. The compressed air delivery orifices 7, 8, as shown in FIG. 2, are also vertically offset from the fiber bundle.

A finish supply tube fitting 21 connects an external source of the finish to the fiber lubricant reservoir 9, which is positioned with its longitudinal axis at approximately a 45° angle with respect to the longitudinal axis of the compressed air plenum 6. Two fiber lubricant delivery orifices 10, 11 are positioned at the distal ends of parallel shafts that extend from the fiber lubricant reservoir 9 into the fiber processing chamber 5. The pair of lubricant delivery orifices 10, 11 are located immediately adjacent each other with a slight space in between, the pair of lubricant delivery orifices 10, 11 being centered inbetween the pair of compressed air delivery orifices 7, 8. This relative placement of the air and finish orifices allows the AFN to apply the finish to the fiber bundle in its "open" state, and then immediately close the opened filaments of the advancing fiber bundle so that the applied finishes are not stripped off by the reattachment of the boundary layer air. Nozzle jet configuration will vary in accordance with optimizing the various parameters (e.g., yarn speed, air pressure, finish flow rate, temperature, etc.) for each combination of finish type and fiber type/coarseness, in order to facilitate the uniform and consistent presentation of the finishes to the advancing yarn. A highly accurate gear metering pump (not shown) is the preferred source of the metered finish supply.

The present invention is not limited regarding the type of multifilament, monofilament and bonded multifilament yarn, but is applicable to all hosiery, textile, techical and industrial yarns on which finish is now applied. Even so there is a practical upper limit to textile yarn size, since the present invention is not applicable to tows. The yarn when a multifilament yarn (including bonded yarn) will have a denier of from about 10 to 6,000 denier with a denier of about 0.1 to 1,000 per filament. Monofilament yarn will often have a denier of about 1.0 to 2,000.

The yarns useable in the practice of the present invention cover the entire spectrum of man-made and natural textile yarns. For example, the textile yarn can be formed of nylon 6; nylon 6.6; polyester (PET, PTT, PBT, etc.); acrylic polymer; polyethylene, polypropylene; can be bi-component (ex.: PE/PP, PET/PE, PET/PP, etc.); can be an elastomeric yarn (including spandex); glass; carbon yarn; cellulosic yarn and so-called advanced yarn types such as Kevlar, Spectra, etc.

Similarly, yarn finish now applied or developed in the future will be usable in the practice of the present invention. Yarn finishes are now applied from neat oil, oil/water and water/oil emulsions, suspensions and solutions, all within the scope of the present invention.

As is well known, the basic function of the fiber finish is to modify frictional and antistatic properties of especially man-made fibers and yarns by the modification of surface properties of the base polymer material. Three major purposes of applying spin finish in the process of man-made fiber production are as follows:

- Provide controlled Fiber-to-Metal (Fiber-to-Ceramic, or any other point of contact) friction and lubrication;
- Provide necessary Fiber-to-Fiber friction and/or cohesion to maintain yarn integrity during processing; and
- Provide required production against build-up of static electricity by the rapid dissipation of generated charges.

In addition to these major purposes, spin finish also may affect fiber and yarn hydrophilicity and hydrophobicity by making fiber or yarn water absorbent or water repellent depending on end-use requirements.

Spin finishes are usually comprised from lubricants, antistats, emulsifiers, and special additives.

Examples of lubricants:

Mineral oils, vegetable oils, animal oils, fatty acid esters, Polyethers, ethylene oxide/propylene oxide copolymers, castor oil, glyceryl esters, silicones.

Examples of emulsifiers:

Fatty acid amine soaps, fatty acid metal soaps, alcohol ether ethoxylates, ethoxylated alkylphenols, ethoxylated glycerides, ethoxylated sorbitol esters.

Examples of antistats:

Quaternary amines ("Quats"), phosphate esters, aliphatic alcohol phosphates and their potassium salts, polyoxyethylene aliphatic alcohol phosphates and their potassium salts.

Although not described herein, the AFN system can also be applied to the manufacture of spandex and other types of elastomeric yarns to increase the finish uniformity and consistency. Such a use would be readily adaptable by one skilled in the art using the system as described above.

Variations of the invention will be apparent to the skilled artisan.

What is claimed is:

1. A process for improving the uniformity of yarn finish application on a rapidly advancing continuous multifilament, monofilament or bonded textile yarn which comprises imparting a pneumatic false twist to the advancing yarn having a wet finish thereon while the yarn is under a tension preventing texturing or increasing coherency in the false twister.

2. The process of claim 1 wherein the yarn is a multifilament yarn, uniformity of yarn finish application is improved on the individual filaments of the yarn by the rapid opening and closing of the yarn.

3. The process of claim 2 wherein the tension is up to about 1.00 grams per denier.

4. The process of claim 3 wherein the tension is up to about 0.10 grams per denier.

5. The process of claim 3 wherein the tension is at least about 0.05 grams per denier.

6. The process of claim 2 wherein the tension is at least about 0.05 grams per denier.

7. The process of claim 2 wherein a yarn finish is injected into the pneumatic false twister to coat the yarn as it advances through the pneumatic false twister.

8. The process of claim 2 wherein the false twist extends linearly along the advancing yarn back into a zone in which a finish is applied to the yarn.

9. An apparatus system for applying finish to a yarn comprising a finish guide applicator or a finish roll applicator, a pneumatic false twister positioned down stream from the guide or roll applicator, and yarn tensioning means for regulating tension of an advancing synthetic multi-filament textile yarn to be at least about 0.05 grams/denier when the yarn carrying a wet finish thereon passes through the pneumatic false twister.

10. The apparatus system of claim 9 wherein the pneumatic false twister includes an injection port for injecting a yarn finish onto and into a synthetic multi-filament textile yarn passing there through.

11. A process for applying finish to a synthetic multi-filament textile yarn comprising contacting the yarn with a finish guide applicator or a finish roll applicator for wetting the yarn with a yarn finish and then passing the yarn carrying the wet finish thereon through a pneumatic false twister for imparting a false twist to the yarn while the yarn is under a tension of at least about 0.05 grams/denier.

12. A process for applying finish to a yarn as in claim 11 comprising also injecting a yarn finish onto and into the yarn while it passes through the pneumatic false twister.

* * * * *